United States Patent [19]

Anklam et al.

[11] Patent Number: 4,556,034

[45] Date of Patent: Dec. 3, 1985

[54] FUEL SUPPLY DEVICE FOR INTERNAL COMBUSTION ENGINES

[75] Inventors: Bruno Anklam, Korntal; Reinhard Köenneker, Moensheim; Hans Mezger, Freiberg, all of Fed. Rep. of Germany

[73] Assignee: Harley-Davidson Motor Co., Inc., Milwaukee, Wis.

[21] Appl. No.: 622,069

[22] Filed: Jun. 19, 1984

[30] Foreign Application Priority Data

Jun. 25, 1983 [DE] Fed. Rep. of Germany ..... 3323010

[51] Int. Cl.[4] ..... F02M 55/02

[52] U.S. Cl. ..... 123/470

[58] Field of Search ..... 123/470, 471, 468, 469

[56] References Cited

U.S. PATENT DOCUMENTS

| | | | |
|---|---|---|---|
| 3,930,483 | 1/1976 | Blisko et al. | 123/470 |
| 4,294,215 | 10/1981 | Hans et al. | 123/470 |
| 4,370,693 | 12/1981 | Glockler et al. | 123/470 |
| 4,474,159 | 10/1984 | Katnik | 123/470 |

FOREIGN PATENT DOCUMENTS

| | | | |
|---|---|---|---|
| 78716 | 5/1983 | European Pat. Off. | 123/470 |
| 2208646 | 8/1973 | Fed. Rep. of Germany | 123/470 |
| 2833659 | 2/1980 | Fed. Rep. of Germany | 123/468 |
| 2024324 | 1/1980 | United Kingdom | 123/470 |

*Primary Examiner*—Magdalen Y. C. Moy

[57] ABSTRACT

A fuel supply device includes a housing having at least one injection valve which is held at both ends by plug-in devices. At the end remote from the injection opening the injection valve cooperates with a holding element which includes fuel ducts and which has a head portion in a bore formed in the housing. The bore is connected to a fuel line. In addition, spaced apart sealing elements are provided on the head portion to define a fuel supply area between the holding element and the bore.

20 Claims, 3 Drawing Figures

FUEL SUPPLY DEVICE FOR INTERNAL COMBUSTION ENGINES

BACKGROUND OF THE INVENTION

This invention relates to a fuel supply device for internal combustion engines with at least one injection valve which is held at both ends in devices, preferably plug-in devices. The injection valve cooperating at the end remote from its injection opening with a holding element which defines fuel ducts.

A known fuel supply device which is disclosed in German Offenlegungsschrift (laid-open specification) No. 22 08 646 is of the type described above comprising an injection valve which is held by means of plug-in connections in an intake pipe and a holding element of a fuel supply pipe.

SUMMARY OF THE INVENTION

The object of the invention is to provide a fuel supply device for an internal combustion engine in which the easily assembled injection valve may be attached to an advantageous fuel line system in a simple manner.

In general terms, the invention comprises a holding element for the fuel injection valve of an internal combustion engine. The holding element has a head portion disposed in a bore connected to fuel supply means. The head portion has a region defining a fuel supply area and sealing means disposed on the opposite of the region and cooperating with the bore to define the margins of the fuel supply area.

The advantages chiefly attained by the invention are evident from the fact that the fuel supply device comprises an easily assembled injection valve which may be satisfactorily attached to fuel lines with the interposition of the piston-like holding element inserted in a bore in a housing. By virtue of the constriction of the holding element the fuel is safely fed to the injection valve. In the fuel supply area of the holding element, escape of fuel (and also the ingress of air) is readily prevented by means of seals which are advantageously mounted in the U-in-cross-section receiving portion of the holding element. In addition, the fuel lines are incorporated in the housing so that the fuel lines, which are otherwise situated outside the housing of the internal combustion engine and which cause an additional manufacturing and assembly outlay, may be dispensed with. Further, the bores of the holding element and the fuel lines are functionally connected to one another in a simple manner by a drilling procedure.

If the internal combustion engine comprises a plurality of cylinders and injection valves, a plurality of eyes with bores for the holding elements of the injection valves may be provided without any problem on the housing, it being possible to connect the said bores to one another by a single fuel line. This fuel line may be easily formed by boring blind-end bores.

One example of an embodiment of the invention is illustrated in the drawing, and is described in greater detail below.

DETAILED DESCRIPTION OF THE PREFERRED EMBODIMENT

Figure 1:
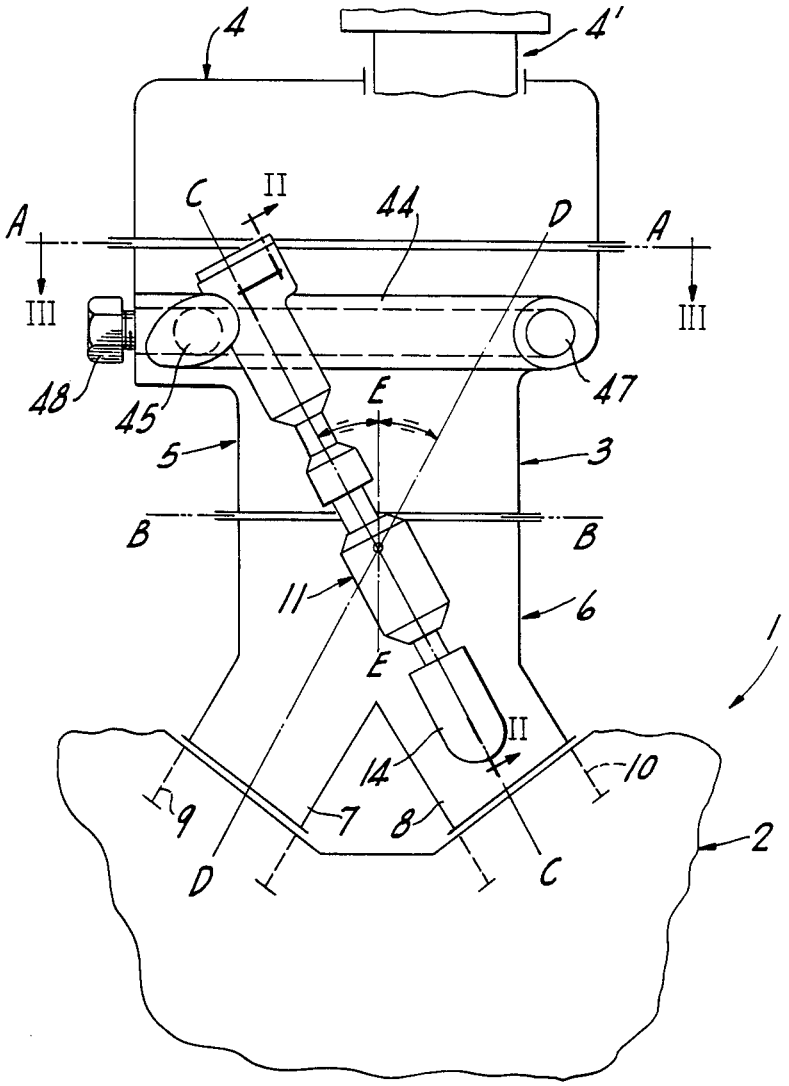
FIG. 1 is a partial view of an internal combustion engine with the fuel injection device according to the invention.

FIG. 1 shows a partial view of an internal combustion engine 1 (of Otto design) which comprises a cylinder head 2 and a fuel supply device 3 connected thereto.

The fuel supply device 3 comprises a housing 5, provided with a covering hood 4 (it has an opening for an air filter which is shown at point 4') and consisting of light-metal casting, and an intake pipe 6 of the same material. The covering hood 4 is connected to the housing 5 and the housing 5 is connected to the intake pipe 6 in the planes A—A and B—B respectively by means of known connecting devices.

The intake pipe 6 is provided with two pipe sections 7 and 8 which are connected to inlet openings 9 and 10 (shown diagrammatically) of the cylinder head 2. A further intake pipe, not visable and disposed behind the intake pipe 6, is designed on the same principle, so that four cylinders are supplied by the fuel supply device 3.

One injection valve 11, which extends outside the housing 5 in the plane C—C, is provided per cylinder or inlet opening. A corresponding injection valve (not shown as it is covered by the intake pipe 6) extends along the plane D—D. The planes C—C and D—D intersect, are disposed at the same angle to a vertical E—E and are orientated obliquely downwards from above.

Figure 2:
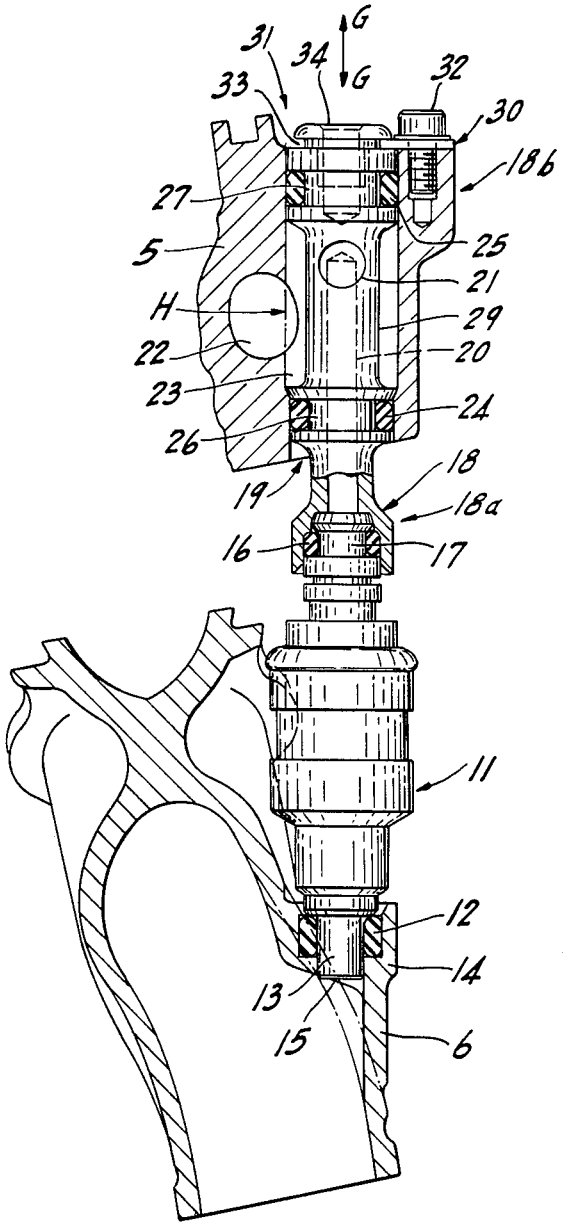
FIG. 2 is a section on a greater scale along the line II—II of FIG. 1.

The injection valve 11 is held with the interposition of a sealing member 12 by a coupler 13 in a receiving pipe section 14 of the intake pipe 6 (FIG. 2). The coupler 13, adjacent to which is the injection opening 15, is in the form of a plug-in device. At the end remote from the injection opening 15 the injection valve 11 cooperates with a holding element 18 with the interposition of a sealing member 16 and a coupler 17, likewise a plug-in device.

The holding element 18 has a female coupler 18*a* at one end which engages the coupler 17 and a piston-like head portion 18*b* disposed in a bore 19 in the housing 5. In addition, the holding element 8 has fuel ducts 20 and 21 formed therein, the first being a longitudinal bore and the second a transverse bore. The bore 19 of the housing 5 intersects and is connected to a fuel line 22, namely in a cylindrical fuel supply area 23 which is provided between the bore 19 and the holding element 18. On both sides of the fuel supply area 23 the holding element 18 cooperates with the bore 19 by way of sealing elements 24 and 25.

The sealing elements 24 and 25 are provided in U-in-cross-section receiving portions 26 and 27 of the holding element 18 and define a constriction 29 in the head portion 18*b* of the holding element 18 which is provided in the fuel supply area 21. A fastening member 30, which effects positive locking and engages on the free end 31 of the holding element 18, is used to secure the holding element 18 in the axial direction G—G. The fastening member 30 is formed by a flat element which rests on the bore 19 and which is held by means of a screw 32 and projects into a groove 33 of the holding element 18 projecting out over the bore 19.

In order that the holding element 18 may be easily changed, an axial threaded bore 34 is provided adjacent the groove 33 for receiving the threaded bolt of an extracting device (not shown).

The fuel line 22 (FIG. 3) is incorporated in the housing 5 and extends essentially transversely to the bore 19, which in turn, extends along the plane C—C extending relatively vertically. The connection H between the bore 19 and the fuel line 22 is effected by drilling intersecting passages.

Figure 3:
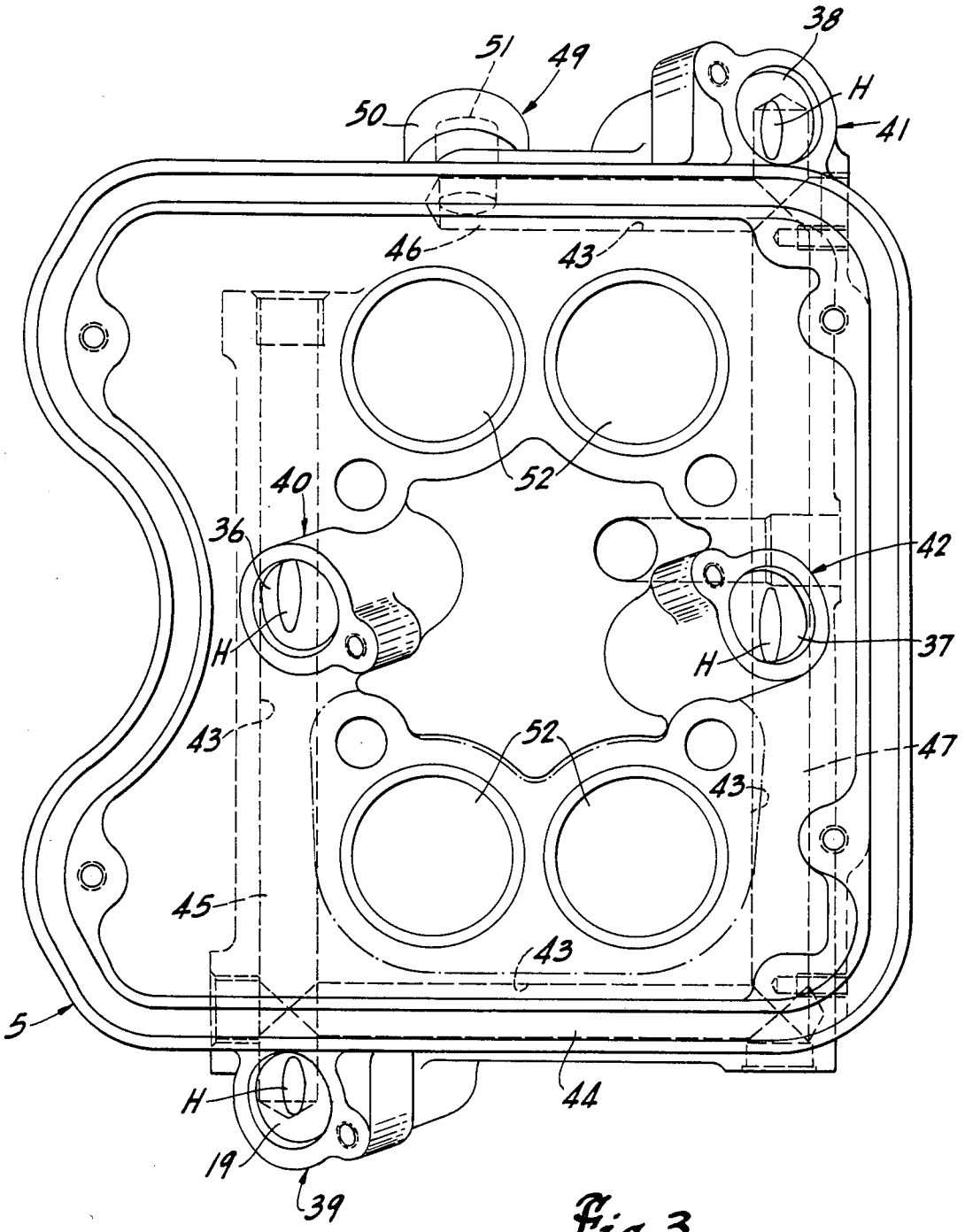
FIG. 3 is a view on a greater scale along the line III—III of FIG. 1.

In order to receive the four injection valves the housing 5 includes the bore 19 and additional bores 36, 37 and 38 which are provided in eyes 39, 40, 41 and 42 as seen in FIG. 3. The bores 19, 36, 37 and 38 are connected to fuel line 43, the fuel line 22 being a component of this line 43 which is formed by blind-end bore passages 44, 45, 46 and 47.

The bored passages 44, 45, 46 and 47 are arranged at right angles to one another, two bores 19 and 40 or 41 and 42 respectively being provided in each case along the bored passages 45 and 47 extending in a parallel manner.

The open ends of the bored passages 44, 45, 46 and 47 may be closed by inserts (not shown), such as screws 48 or press-in elements (FIG. 1).

An additional eye 50 with a bore 51, by way of which the fuel is fed into the annular line 43, is provided at 49 on the housing 5.

In addition, the housing 5 is provided with through openings 52 for conveying the air for combustion, into which movable throttle valves (not shown in greater detail) may be inserted.

I claim:

1. A fuel supply device for an internal combustion engine, said device including a housing having a bore, fuel supply means and at least one fuel injection valve having opposite end portions which are constructed and arranged to be supported, said injection valve having an injection opening and first holding means engaging the end portion of the valve having the injection opening and a second holding means including a connector engaging the end of the valve remote from the injection opening, the improvement wherein the second holding means has a piston like head portion disposed in said bore, said bore being connected to said fuel supply means, said head portion having a recessed region defining a fuel supply area and spaced apart sealing means disposed on the opposite sides of said fuel supply area and cooperating with the bore to define the margins of the fuel supply area, and a first passage in said second holding means between said fuel supply region and the connector.

2. A fuel supply device set forth in claim 1 wherein the second holding means has a constriction formed therein for defining the fuel supply area.

3. The fuel supply device as set forth in claim 1 wherein the sealing means are disposed in recesses formed in the second holding means.

4. The fuel supply device as set forth in claim 1 wherein fastening means is provided on said housing to secure the second holding means from movement relative to said bore.

5. A fuel supply device as set forth in claim 1 wherein said fuel supply means includes a second passage formed in the housing and extending transversely to the bore, said bore and second passage intersecting to form a connection therebetween.

6. The fuel supply device set forth in claim 5 wherein said internal combustion engine includes a plurality of cylinders, a fuel injection valve coupled to each of said cylinders, a plurality of second holding means each engaging one of said valves, a plurality of bores formed in said housing, one of said second holding means being disposed in each of said bores, a second passage extending between and communicating with each of said bores.

7. The fuel supply device set forth in claim 6 wherein said second passages are formed by a plurality of intersecting linear passages formed in said housing, each of said linear passages extending between and intersecting a pair of said bores.

8. The fuel supply device set forth in claim 7 wherein said engine includes four cylinders, said linear passages and each extending between a pair of bores and at right angles to each other.

9. The fuel supply device as set forth in claim 2 wherein the sealing means are disposed in recesses formed in the second holding means.

10. The fuel supply device as set forth in claim 9 wherein fastening means is provided on said housing to secure the second holding means from movement relative to said bore.

11. The fuel supply device as set forth in claim 10 wherein said fuel supply means comprises a second passage formed in a housing and extending transversely to the bore, said bore and second passage intersecting to form a connection therebetween.

12. The fuel supply device as set forth in claim 11 wherein said internal combustion engine includes a plurality of cylinders, a fuel injection valve coupled to each of said cylinders, a plurality of said second holding means each engaging one of said valves, a plurality of bores formed in said housing, one of said second holding means being disposed in each of said bores, a second passage extending between and communicating with each of said bores.

13. The fuel supply device as set forth in claim 12 wherein said second passages are formed by a plurality of intersecting linear passages formed in said housing, each of said linear passages extending between and intersecting a pair of said bores.

14. The fuel supply device as set forth in claim 13 wherein said engine includes four cylinders, said linear passages each extending between a pair of bores and at right angles to each other.

15. The fuel supply device as set forth in claim 14 wherein each of said linear passages comprises bores formed in said housing, and insert means disposed at the outer end of each bore for closing the same.

16. The fuel supply device as set forth in claim 15 wherein one end of the second holding means engages the injection valve, a groove formed in the other end of the second holding means, the fastening means comprises a flat member secured to the housing and projecting into the groove.

17. The fuel supply device as set forth in claim 16 wherein said injection valve has plug-in connectors at each of its end portions.

18. The fuel supply device set forth in claim 1 wherein said head portion has an outer surface, said recessed region being formed in said outer surface.

19. A fuel supply device for an internal combustion engine, said device including a housing having a bore, fuel supply means and at least one fuel injection valve having opposite end portions which are constructed and arranged to be supported, said injection valve having an injection opening and holding means cooperating with the end portion of the valve remote from the injection opening, the improvement wherein the holding means has a head portion disposed in said bore, said bore being connected to said fuel supply means, said head portion having a region defining a fuel supply area, .sealing means disposed on the opposite sides of said fuel supply area and cooperating with the bore to define the margins of the fuel supply area, one end of the holding means engaging the injection valve, a groove formed in the other end of the holding means, and fastening means provided on said housing to secure the holding means from movement relative to said bore and comprising a flat member secured to the housing and projecting into the groove.

20. A fuel supply device for an internal combustion engine having four cylinders, said device including a housing having a plurality of bores, fuel supply means and at least one fuel injection valve coupled to each of said cylinders, said valves having opposite end portions which are constructed and arranged to be supported, said injection valves each also having an injection opening, a plurality of holding means each cooperating with the end portion of one valve remote from its injection opening, each holding means having a head portion disposed in one of said bores, said bores being connected to said fuel supply means, said head portions each having a region defining a fuel supply area and sealing means disposed on the opposite sides of said fuel supply area and cooperating with the bore to define the margins of the fuel supply area, said fuel means comprises a plurality of intersecting linear passages formed in said housing, each of said passages extending between and intersecting a pair of said bores and at right angles to each other, each of said passages comprising bores formed in said housing, and insert means disposed at the outer end of each bore for closing the same.

* * * * *